United States Patent [19]

McCullough

[11] Patent Number: 4,619,335

[45] Date of Patent: Oct. 28, 1986

[54] ENHANCED CIRCULATION DRILL BIT

[76] Inventor: Doyle W. McCullough, P.O. Box 90484, Houston, Tex. 77290

[21] Appl. No.: 641,577

[22] Filed: Aug. 16, 1984

[51] Int. Cl.[4] ..... E21B 10/18; E21B 10/60

[52] U.S. Cl. ..... 175/339; 175/340; 175/422 R

[58] Field of Search ..... 175/339, 422, 340, 331, 175/393; 239/383

[56] References Cited

U.S. PATENT DOCUMENTS

| | | | |
|---|---|---|---|
| 2,873,092 | 2/1959 | Dwyer | 175/61 |
| 2,945,678 | 7/1960 | Boudreaux et al. | 175/317 |
| 3,360,057 | 12/1967 | Anderson | 175/67 |
| 3,416,613 | 12/1968 | Henderson | 173/57 |
| 3,762,648 | 10/1973 | Deines et al. | 239/383 |
| 3,801,019 | 4/1974 | Trenary et al. | 239/383 |
| 3,897,836 | 8/1975 | Hall et al. | 175/93 |
| 4,022,285 | 5/1977 | Frank | 175/65 |
| 4,071,097 | 1/1978 | Fulop et al. | 175/56 |
| 4,077,482 | 3/1978 | Ioannesian et al. | 175/340 |
| 4,079,891 | 3/1978 | Kwan | 239/101 |
| 4,081,135 | 3/1978 | Tomaro | 239/102 |
| 4,083,417 | 4/1978 | Arnold | 175/393 |
| 4,101,075 | 7/1978 | Heitzman | 239/101 |
| 4,102,418 | 7/1978 | Kammerer, Jr. | 175/324 |
| 4,102,419 | 7/1978 | Klima | 175/371 |
| 4,114,705 | 9/1978 | Milan | 175/340 |
| 4,126,194 | 11/1978 | Evans | 175/340 |
| 4,131,233 | 12/1978 | Koenig | 239/381 |
| 4,137,975 | 2/1979 | Pennock | 175/65 |
| 4,185,706 | 1/1980 | Baker, III et al. | 175/340 |
| 4,187,921 | 2/1980 | Garner | 175/340 |
| 4,189,014 | 2/1980 | Allen et al. | 175/339 |
| 4,254,914 | 3/1981 | Shames et al. | 239/383 |
| 4,262,757 | 4/1981 | Johnson, Jr. et al. | 175/67 |
| 4,361,282 | 11/1982 | DiVito | 239/383 |
| 4,389,071 | 6/1983 | Johnson, Jr. et al. | 299/14 |

OTHER PUBLICATIONS

Baker; William, *Drilling*, Jul. 1983, "Innovations in Rock Bit Design, Hydraulics", pp. 82–86.

Institut Francais Du Petrole, Industrial Direction, "New Drilling Tools: Improved Hydraulics for Rock Bits", Nov. 1979.

*Primary Examiner*—Stuart S. Levy

*Assistant Examiner*—Thomas R. Hannon

*Attorney, Agent, or Firm*—Pravel, Gambrell, Hewitt & Kimball

[57] ABSTRACT

The enhanced flow drill bit includes an upper body section having a bore therein and a lower body section formed integrally with the upper body section and including three passageways to transmit fluid outwardly of the drill bit body. The passageways, when intermittently open, transmit fluid flowing downwardly through the drill bit body and outwardly of the passageways to cause a cross flow in the area of the cone-type cutters. A rotor is mounted within a bore within the upper body section to intermittently open and close passageways to provide for an intensification of flow through the remaining open passageway to create high jet impact force of fluid flowing outwardly of the drill bit body to enhance cross flow and the removal of drill cuttings.

4 Claims, 6 Drawing Figures

ENHANCED CIRCULATION DRILL BIT

TECHNICAL FIELD OF THE INVENTION

This invention relates to oil well or other drilling utilizing a drill bit with drilling fluid circulating therethrough.

BACKGROUND OF THE INVENTION

In order to drill an oil or gas well, it is well-known to mount a drill bit at the bottom end of a line of drill pipe, commonly known as a drill string, and to rotate the drill bit and drill string into the earth in order to drill a borehole. Typically, a drill bit consists of a drill body which supports drill bits which are rotated by the rotation of the drill string in order to cause the bits to grind and cut through the earth's formation. The grinding and cutting action of the drill bit creates drill cuttings which have to be removed from the bottom of the borehole so that the drill bit can continue its grinding and cutting without bogging down. In order to remove such drill cuttings, to clean and cool the drill bits, and for other reasons, it is known to circulate a drilling fluid, commonly known as "mud", downwardly through the drill string and outwardly of the drill bit with the fluid circulating upwardly in the annular area between the drill string and the borehole walls thus returning to the earth's surface. Upon return to the earth's surface, the drilling fluid is cleaned for re-circulation.

The importance of efficient removal of the drill cuttings cannot be over emphasized. Without efficient removal of the cuttings, the drill bit tends to re-grind the drill cuttings and thus lose efficiency. Efficiency of operation of the drill bit is directly proportional to the effectiveness of the removal of drill cuttings.

A number of attempts have been made to enhance removal of drill cuttings. U.S. Pat. No. 3,216,514 of Nelson discloses a rotary drilling apparatus having a valve means in the drill bit housing which is rotated in response to rotation of the drill bit comes due to the mechanical interconnection between the drill bit cones and the valve means. The valve means opens and closes passageways in the drill bit body in order to, as is taught in the patent, interrupt flow of fluid in the bit in order to cause a sudden downward force or water hammer effect to be exerted on the bit to increase the pressure of cutters on the formation and to reduce the hydrostatic pressure exerted by the fluid on the formation whereby the cuttings will be more readily broken away from the formation and entrained in the drilling fluid to be carried upwardly through the annulus. U.S. Pat. No. 4,114,705 of Milan discloses a drill bit utilizing two opposed pulsed jets 180° out of phase which is achieved by utilizing a pivotally mounted ball which oscillates between two positions to respectively close off one of two outlet ducts leading to the nozzles to produce alternating pulsed flow. U.S. Pat. No. 3,897,836 of Hall and Clipp discloses the utilization of a hammer and piston internally mounted in a housing above the drill bit to cause continuously supplied compressed air to cyclically operate the hammer and piston to create a pulsed jet of water. Other attempts to enhance the removal of drill cuttings include the use of nozzles having certain flow restriction charactetristics and extended tubes extending downwardly from the bit housing to enhance cross flow. It has also been taught to combine extended nozzles with return conduits to enhance cross flow.

While many attempts have therefore been made to enhance circulation of drilling fluid outwardly of the drill bit in order to remove drill cuttings, it is believed that the state of the art may yet be improved.

SUMMARY OF THE INVENTION

It is the object of this invention to provide a new and improved enhanced circulation drill bit adapted to be mounted at the end of the drill string for enhancing the removal of drill bit cuttings from the bottom of the borehole being drilled. It is a further object of this invention to provide a new and improved means for intermittently concentrating the flow of drilling fluid through the drill bit in order to increase the jet impact force of the fluid. The enhanced circulation drill bit includes a drill body having an upper body section adapted to be attached to a drill string and a lower body section having thereon a drill bit. The upper body section has a bore therein in fluid communication with the drill string in order to receive circulating drilling fluid. The lower body section includes a plurality of passages which extend from the the bore of the upper body section and terminate outwardly of the lower body section in proximity to the drill bit cones. A flow response means is mounted for rotation within the bore of the upper body section for intermittently opening and closing off flow through the passages in response to the velocity of the circulating drilling fluid in order to deliver intermittent high velocity flow downwardly and outwardly of the drill bit to enhance cross circulation and removal of drill cuttings.

This description of this invention is intended as a summary only. The patentable features of this invention will be described in the claims and the structure and function of the drill bit of this invention will be described in the description of the preferred embodiment to follow.

DESCRIPTION OF THE PREFERRED EMBODIMENT

Figure 1:
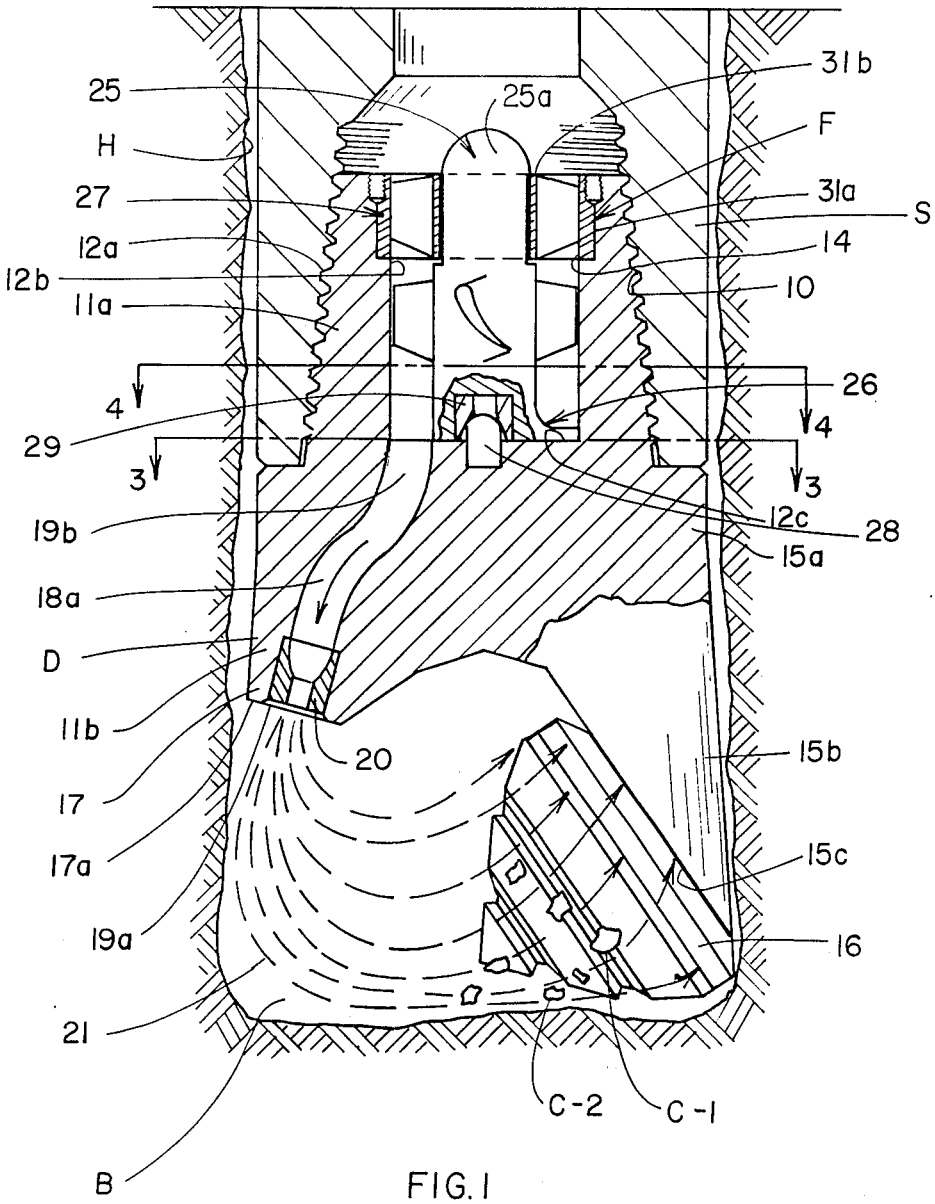
FIG. 1 is a side view partly in section of the enhanced flow drill bit of the preferred embodiment of this invention illustrating schematically the enhanced cross flow provided by this invention.

Referring to the drawing and in particular to FIG. 1, the enhanced circulation drill bit D is illustrated in operating position at the bottom B of the borehole generally designated as H. The drill bit D is mounted at the end of a drill string generally designated as S. Typically, the drill string S consists of a series of drill pipes screwed together to provide a mechanical connection and internal passageway from the drilling rig at the surface down to the bottom of the drill string and to the drill bit D attached at the end of the drill string. The actual final joint of the drill string S may be a drill bit coupling joint or a heavier type of drill pipe known as drill collar. Whether the end of drill string S is typical drill pipe, a drill bit coupling or joint or drill collar, each of these types of joints terminate in an internally threaded "box" end portion designated as 10. The enhanced circulation drill bit D of the preferred embodiment of this invention is threadedly attached to the internally threaded end portion 10 of the drill string S. This drill string type S includes an internal bore extending all the way from the surface rig down to the drill bit to allow for the flow of drilling fluid downwardly into the drill bit D in a well-known manner.

The enhanced circulation drill bit D of the preferred embodiment of this invention is provided for enhancing the removal of drill bit cuttings such as C-1 and C-2 which have been ground and/or cut out of the earth by the drill bit D. The drill bit D includes an upper or first generally cylindrical body section 11*a* and a lower or second generally cylindrical body section 11*b* formed integrally with the upper body section 11*a*. The upper body section 11*a* is frusto-conical and has an outer, upper and inwardly tapered surface 12*a* threaded for threaded engagement with the internally threaded end portion 10 of the bottom of the drill string S. The upper body section 11*a* further includes an internal bore 14 formed by cylindrical internal wall 12*b*, the bore wall 12*b* terminating in a bottom circular flat surface 12*c*. The bore 14 is formed by the internal cylindrical wall 12*b* and bottom circular wall 12*c*.

The lower body section 11*b* is integrally formed with the upper body section 11*a* and includes a generally cylindrical main lower body portion 15*a* having three circumferentially spaced support legs such as 15*b* depending downwardly from the main lower body portion 15*a*. Referring to FIG. 1, only support leg 15*b* is actually shown but it is understood that there are three support legs such as 15*b* circumferentially spaced 120° apart about the bottom of the main lower body portion 15*a*. In a manner known in the art, each of the support legs such as 15*b* has a cone-type cutter 16 mounted onto an internal support surface 15*c* for rotation in response to rotation of the drill string S. Typically, the cone-type cutters 16 are mounted by sealed bearings to provide for rotation and engagement of the drill bit against the earth in response to rotation of the drill string. Although there are many patents directed to various features of the mounting of cone-type cutters, the reader is referred for the purposes of example only to the previously mentioned U.S. Pat. Nos. 3,216,514; 4,114,705 and 3,897,836 all which disclose various bearings and seals for mounting the cone-type drill bits.

Figure 3:
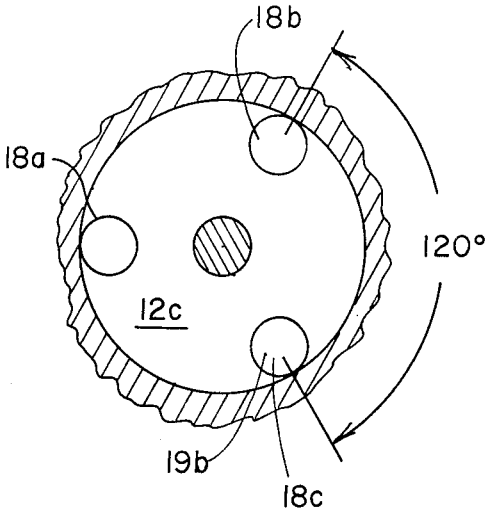
FIG. 3 is a sectional view taken along line 3—3 of FIG. 1 illustrating the circumferential spacing of the three passageways through the lower section of the drill bit body.

The lower body section 11*b* further includes three circumferentially spaced nozzle landings such as 17 which extend downwardly and provide a bottom nozzle face 17*a* in between each of the depending support legs 15*b* for the cone-type cutters 16. Three passageways such as 18*a–c* are machined into the lower body section 11*b* for providing the fluid communication between the upper body section bore 14 and the bottom B below the drill bit D. Each of the passageways 18*a* illustrated in FIG. 1 and 18*a–c* illustrated in FIG. 3 terminate at their upper end opening 19*b* into the circular bottom 12*c* of the upper body section bore 14. The passageways 18*a–c* each extend in a generally "S" direction in cross-section (FIG. 1) downwardly and terminate in an opening 19*a* in the landing faces such as face 17*a* of each of the three landings such as 17. The passages are round in cross-section and have mounted at their lower end 19*a* a constricting flow nozzle insert 20 which includes an outer portion of constricted diameter to increase the velocity of fluid exiting through each passageway. The flow of fluid outwardly from the passageway 18*a* of FIG. 1 is schematically illustrated by a series of directional arrows 21. Fluid is circulated through passageways 18*a–c* down into the area around the cone-type cutters such as 16 and then upwardly in the recessed area between the three depending support legs such as 15*b*.

If the drill cuttings such as C-1 are not sufficiently removed, the drill cuttings tend to be re-ground by the drill bit thus creating inefficiency and loss of effective penetration. However, the drill bit D of the preferred embodiment of this invention further includes a flow response means generally designated as F mounted in the upper body section bore 14 for intermittently opening and closing the passageways 18*a–c* in some combination in response to the velocity of fluid entering the upper body section bore 14 in order to provide for the delivery of intermittent high velocity flow outwardly of one or more of the nozzles 18*a–c* to enhance cross circulation and removal of drill bit cuttings out of the path of the rotating drill bit D.

The drilling fluid typically circulates downwardly through the passageway in the drill string S and through a drill bit such as D and outwardly of variously placed nozzles. In the embodiment illustrated, the fluid circulates downwardly through the passageway in the drill string S through the upper body section bore 14 of the drill bit D and outwardly through the passageways 18*a–c* into the newly created borehole area bottom B wherein the cone-type cutters 16 are cutting into the earth's surface. The flow response means F is provided for alternately opening and closing flow through one or more of the openings 18*a–c* in order to cause a channeling of flow at increased pressure through various of the passages 18*a–c*. The flow response means F includes a rotation means generally designated as 25 mounted within the upper body section bore 14 for rotating therein in response to the flow of fluid entering the bore. The rotation means includes a flow blocking means illustrated in particular in FIGS. 4–6 and generally designated by the number 26 mounted with the rotation means 25 for rotation therewith. The flow blocking means 26 provides for the intermittent blocking of the flow into one, but less than all of the passageways 18*a–c* from the upper body section bore 14 as the rotation means 25 rotates. A flow director means generally designated as 27 is mounted upstream of the rotation means for directing fluid flow against the rotation means 25 to cause rotation of the rotation means.

The rotation means 25 is a cylindrically-shaped rotor 25*a* having a rounded upper end. The rotation rotor 25*a* is cylindrical in configuration such that an annular space is created between the outside surface of the rotor 25*a* and the internal wall 12*b* of the upper body section bore 14. The rotation rotor 25*a* is mounted for rotation within the bore 14 by a thrust and radial bearing mounting member 28 which is mounted into the lower body section and extends upwardly at the center of the circular bottom face 12*c* of the bore 14. This mounting member 28 receives a support bearing 29 which is mounted in a recess in the bottom portion of the rotor 25*a* whereby the bearing support member 25 and the thrust and radial bearing mount member 28 cooperate to provide means mounting the rotor for rotation.

Figure 2:
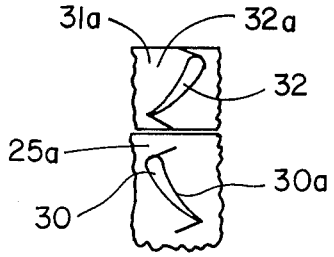
FIG. 2 is a side view of the static and rotating vanes utilized in the flow director and rotation means of this invention.

Referring to FIGS. 1 and 2, rotor 25*a* has mounted thereon a plurality of circumferentially spaced vanes 30 which extend radially outwardly from the outside surface of the rotor 25*a* into the annular area between the rotor 25*a* and the bore wall 12*b*. The vanes 30 are circumferentially spaced about the rotor 25*a* and include a fluid impinging surface 30*a* which receives fluid flow that drives the vanes and imparts rotational motion to the rotor 25*a*.

The flow director means 27 comprises first and second concentric stationary mounting rings 31*a* and 31*b* having welded or otherwise attached between the mounting rings a plurality of static vanes 32 which thus extend radially between the mounting rings 31*a* and 31*b*. Each of the vanes 32 includes a fluid impinging surface 32*a* which is inclined in a direction opposite to the fluid impinging surface 30*a* of the rotor vanes 30 whereby fluid is directed by the static vanes surfaces 32*a* in a direction to impinge against the rotor vane surfaces 30*a* in order to cause more efficient rotation of the rotor 25*a*. The concentric mounting rings 31*a* and 31*b* cooperate with the static vanes 32 connected there between to provide a static vane mount means fixedly attaching the vanes 32 for directing fluid flow against the rotor vanes 30. Set screws are provided for threadedly engaging the outer mounting ring 31*a* and the upper portion of the upper body section 11*a* for holding the mounting rings 31*a* and 31*b* in position. Therefore, the static vanes 32 are mounted in the annular space between the rotor and the internal cylindrical wall 12*b* of the bore 14 to direct fluid entering the annular space downwardly and at an angle of incline to directly impinge upon the rotor vanes 30 and cause rotation of the rotor. The static vanes create a directional vortex of flow to direct against the vanes of the rotor and then continue downwardly in the annular space between the rotor 25*a* and bore wall 12*b* toward the first openings 19*a* of the passages 18*a–b*.

Figure 4:
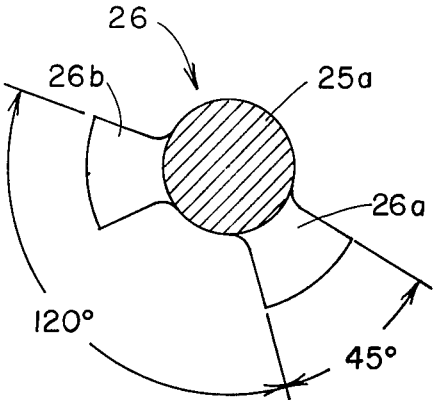
FIG. 4 is a sectional view through the rotor of the rotation means through a plane along line 4—4 of FIG. 1 illustrating the arc size and location of flow blocking element.
Figure 5:
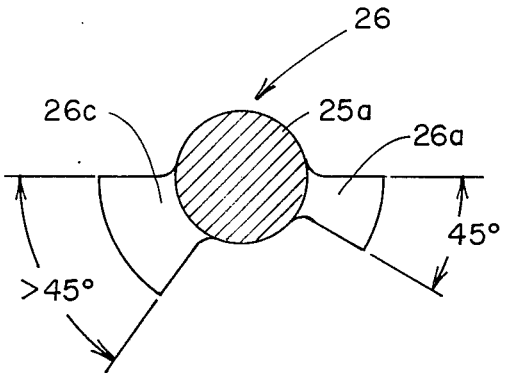
FIG. 5 is a view similar to FIG. 4 illustrating a variation in the location and size of the flow blocking element.
Figure 6:
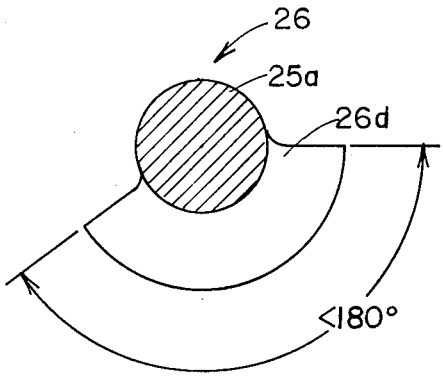
FIG. 6 is a view similar to FIGS. 5 and 4 illustrating another variation in the size of the flow blocking element.

Flow blocking means generally designated in FIG. 1 as 26 are mounted onto the bottom of rotor 25*a* and extend radially outwardly from the rotor into the annular space between the rotor and the interior wall 12*b* of the bore 14 for rotation with the rotor and intermittent blocking of one or more of the passageways 18*a–c*. Referring to FIGS. 4–6, various configurations for the flow blocking means 26 are provided. The flow blocking means includes one or more radially extending flanges or lobes such as 26*a* and 26*b* in FIG. 4 which extend radially outwardly into the annular space between the rotor 25*a* and the internal bore wall 12*b*. Referring to FIG. 4, the lobes 26*a* and 26*b* each have a circumferential arc of approximately 45°. The two lobes are spaced apart a circumferential arc of 120°. In operation, rotation of the rotor 25*a* will cause the lobes 26*a* and 26*b* to cover one or two of the ports 18*a–c* at one time thereby concentrating flow in the remaining open passageways and thus increasing the pressure in the remaining open passageways to cause an intensification of the resultant flow through the remaining open passageway. This intensification causes an effect which enhances cross flow of the drilling fluid leaving the temporarily open passageway such as 18*a* illustrated in FIG. 1 thereby enhancing cross flow in the direction of arrows 21 and removal of cuttings such as C-1 and C-2.

Referring to FIG. 5, an alternate design for the flow blocking means 26 is illustrated which includes a lobe 26*a* having the 45° circumferential arc and a lobe 26*c* having greater than a 45° arc. Referring to FIG. 6, a single lobe 26*d* is illustrated which has a circumferential arc greater than 120° but less than 180°. In each instance, rotation of the rotor 25*a* will cause alternate opening and closing of the passageways 18*a–c* in some combination to thereby concentrate flow through less than all three openings intermittently to cause pressure and velocity concentration through the remaining openings such as 18*a* to thereby create cross flow and cause a greater impact of the fluid against the bottom of the borehole to further enhance drilling. It is within the scope of this invention to utilize various numbers and arc sizes of lobes to create various pressures as necessary to operate under varying drill conditions.

The advantages of this invention can be described in terms of the following formulas recognized to apply to downhole drilling fluid circulation. The mud flows through the drill string to the drill bit at constant volume due to positive displacement pumps. Therefore, whenever all of the flow is channeled through one bore, the flow rate remains constant and therefore in accordance with the following formula, the jet velocity of the channelized flow increases due to the decrease in $A_n$:

$$V_n=(0.32086\,A)/Q_n$$

Accordingly, the increase in the jet velocity results in an increase in the jet impact force as follows:

$$I_f=0.000516pQV_n$$

Nomenclature:

Q=Circulation Rage (gpm)
p=Mud Weight (lb/gal)
$A_n$=Area of Nozzle ($in^2$)
$V_n$=Jet Velocity (ft/sec)
$I_f$=Jet Impact Force (lb)

In this manner, it is believed that the maximum hydraulic energy available from the constant volume flow is obtained resulting in a greater impact and a greater circulation of cuttings outwardly through the annulus through the intermittent application of the mud flow outwardly of the single nozzle at a stronger force. It is believed that the increased force of impact hitting the bottom of the hole causes a deflection within the hole which further enhances the cross-flow.

The foregoing disclosure and description of the invention are illustrative and explanatory thereof, and various changes in the size, shape and materials, as well as in the details of the illustrated construction may be made without departing from the spirit of the invention. For example, the type of drill bit body illustrated in the drawing is a cone-type bit body having three dependent legs. This invention is applicable to other types of drill bit bodies which are generally cylindrical such as diamond bits and the newer polycrystalline diamond bits utilizing a series of studs having polycrystalline diamond compact surfaces.

While the drilling fluid has been described as liquid, it is within the scope of this invention to utilize a gas such as air as the drilling fluid. It should be understood that, although the drill bit D of the preferred embodiment of this invention has been described with respect to a vertical borehole utilized in oil and gas well drilling, the drill bit D may be used in variously directed boreholes for oil and gas well drilling. Additionally, the drill bit D of the preferred embodiment of this invention may be used in horizontal operations such as in mining wherein drill bits are utilized to form horizontal boreholes.

I claim:

1. An enhanced circulation drill bit adapted to be mounted at the end of a drill string for enhancing the removal of drill bit cuttings from the bottom of the borehole being drilled, comprising:

a drill body having an upper body section adapted to be attached to a drill string and a lower body section having mounted therewith a plurality of cone-type cutters;

said upper body section having a bore therein adapted to be in fluid communication with the bore of the drill string to receive drilling fluid flowing downwardly through the drill string;

said lower body section having three passageways therethrough, each of said passageways having a first and a second end opening, said passageways being in fluid communication with said bore of said upper body section at said first end opening and said passageways extending through said lower body section to a second end opening;

flow response means mounted in said upper body section bore for intermittently opening and closing said passageways in response to the flow of fluid entering said upper body section bore in order to intermittently deliver concentrated high velocity flow outwardly of said second end of a passageway to the end of the borehole to increase jet impact force and enhance cross circulation and removal of drill bit cuttings;

said flow response means includes rotation means mounted with said upper body section bore for rotating therein in response to fluid entering said bore, said rotation means including a rotor and rotation mount means is mounted with said rotor and with said drill body for mounting said rotor for rotation in said bore of said upper body section;

flow blocking means mounted with said rotation means and rotating therewith for intermittently blocking flow to said passageways as said rotation means rotates, said flow blocking means including a flow blocking element mounted with said rotor and moving circumferentially to intermittently block off flow to one or more of said first ends of said passageways;

flow director means for directing fluid flow against said rotation means to cause rotation thereof, said flow director means mounted with said upper body section in said bore thereof for directing fluid flow against said rotor to cause rotation thereof;

said rotor having vanes mounted thereon, said vanes extending radially outwardly for implementing rotation of said rotor in response to fluid flow;

said flow director means including static vanes;

static vane mount means fixedly attaching said vanes in said upper body section bore upstream of said rotor mounted vanes for directing fluid flow against said rotor mounted vanes;

said rotor is mounted centrally of said upper body section bore, said upper body section bore and said rotor being cylindrical such that an annular flow space is formed therebetween;

said rotor vanes and said static vanes being mounted in said annular space; and said rotor vanes and said static vanes having opposing inclined surfaces.

2. The structure set forth in claim 1, wherein said flow blocking element is:

a first radially extending lobe having an arc of about 45°; and a second radially extending lobe having an arc of about 45°, said second radially extending lobe being positioned about 120° from said first radially extending lobe.

3. The structure set forth in claim 1, wherein said flow blocking element is:

a first radially extending lobe having an arc of about 45°; and a second radially extending lobe having an arc of greater than 45°.

4. The structure set forth in claim 1, wherein said flow blocking element is a radially extending lobe greater than 120° but less than 180°.

* * * * *

UNITED STATES PATENT AND TRADEMARK OFFICE

CERTIFICATE OF CORRECTION

PATENT NO. : 4,619,335

DATED : October 28, 1986

INVENTOR(S) : Doyle W. McCullough

It is certified that error appears in the above-identified patent and that said Letters Patent is hereby corrected as shown below:

Column 1, Line 41: "comes" should be "cones";

Column 1, Line 65: "characteristics" is misspelled;

Column 6, Line 37: "Rage" should be "Rate".

Signed and Sealed this

Twenty-seventh Day of January, 1987

*Attest:*

DONALD J. QUIGG

*Attesting Officer* *Commissioner of Patents and Trademarks*